US006439382B1

(12) United States Patent
Wolfe

(10) Patent No.: US 6,439,382 B1
(45) Date of Patent: Aug. 27, 2002

(54) NEEDLE AND PIN CAP ASSEMBLY

(76) Inventor: Lisa R. Wolfe, 2932 Shefield Ct., Green Bay, WI (US) 54311

( * ) Notice: Subject to any disclaimer, the term of this patent is extended or adjusted under 35 U.S.C. 154(b) by 9 days.

(21) Appl. No.: 09/666,925

(22) Filed: Sep. 21, 2000

(51) Int. Cl.[7] ..... B65D 85/24
(52) U.S. Cl. ..... 206/380; 206/382; 66/116
(58) Field of Search ..... 206/365, 380, 206/382, 383, 583; 66/116, 117, 118

(56) References Cited

U.S. PATENT DOCUMENTS 609,061 A * 8/1898 Waymack ..... 66/116
997,474 A * 7/1911 Stuckel ..... 66/116
D54,755 S * 3/1920 Kinney
D130,362 S * 11/1941 Sachs
2,644,324 A * 7/1953 Spencer

* cited by examiner

*Primary Examiner*—David T. Fidei

(57) ABSTRACT

A needle and pin cap assembly for eliminating a user from being cut or stuck with the needle or pin. The needle and pin cap assembly includes a first cap member assembly including a first cap member having a side wall an open end, a closed end, and a cavity disposed therein; and also includes a second cap member having a side wall, a first end, and a second end which is adapted to receive a head portion of a needle or pin there through; and further includes an elastic elongate member being connected to the first cap member and to the second cap member and being adapted to hold the first end cap member and the second end cap member upon ends of the needle or pin.

1 Claim, 4 Drawing Sheets

NEEDLE AND PIN CAP ASSEMBLY

BACKGROUND OF THE INVENTION

1. Field of the Invention

The present invention relates to caps for needles and pins. and more particularly pertains to a new needle and pin cap assembly for eliminating a user from being cut or stuck with the needle or pin.

2. Description of the Prior Art

The use of caps for needles and pins is known in the prior art. More specifically, caps for needles and pins heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,328,832; U.S. Pat. No. 2,040,289; U.S. Pat. No. 4,253,452; U.S. Pat. No. 4,293,355; U.S. Pat. No. 2,413,800; and U.S. Pat. No. Des. 245,202.

While these devices fulfill their respective, particular objectives and requirements, the aforementioned patents do not disclose a new needle and pin cap assembly. The inventive device includes a first cap member assembly including a first cap member having a side wall, an open end, a closed end, and a cavity disposed therein; and also includes a second cap member having a side wall, a first end, and a second end which is adapted to receive a head portion of a needle or pin there through; and further includes an elastic elongate member being connected to the first cap member and to the second cap member and being adapted to hold the first end cap member and the second end cap member upon ends of the needle or pin.

In these respects, the needle and pin cap assembly according to the present invention substantially departs from the conventional concepts and designs of the prior art, and in so doing provides an apparatus primarily developed for the purpose of eliminating a user from being cut or stuck with the needle or pin.

SUMMARY OF THE INVENTION

In view of the foregoing disadvantages inherent in the known types of caps for needles and pins now present in the prior art, the present invention provides a new needle and pin cap assembly construction wherein the same can be utilized for eliminating a user from being cut or stuck with the needle or pin.

The general purpose of the present invention, which will be described subsequently in greater detail, is to provide a new needle and pin cap assembly which has many of the advantages of the caps for needles and pins mentioned heretofore and many novel features that result in a new needle and pin cap assembly which is not anticipated, rendered obvious, suggested, or even implied by any of the prior art caps for needles and pins, either alone or in any combination thereof.

To attain this, the present invention generally comprises a first cap member assembly including a first cap member having a side wall, an open end, a closed end, and a cavity disposed therein;

and also includes a second cap member having a side wall, a first end, and a second end which is adapted to receive a head portion of a needle or pin there through; and further includes an elastic elongate member being connected to the first cap member and to the second cap member and being adapted to hold the first end cap member and the second end cap member upon ends of the needle or pin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new needle and pin cap assembly which has many of the advantages of the caps for needles and pins mentioned heretofore and many novel features that result in a new needle and pin cap assembly which is not anticipated, rendered obvious, suggested, or even implied by any of the prior art caps for needles and pins, either alone or in any combination thereof.

It is another object of the present invention to provide a new needle and pin cap assembly which may be easily and efficiently manufactured and marketed.

It is a further object of the present invention to provide a new needle and pin cap assembly which is of a durable and reliable construction.

An even further object of the present invention is to provide a new needle and pin cap assembly which is susceptible of a low cost of manufacture with regard to both materials and labor, and which accordingly is then susceptible of low prices of sale to the consuming public, thereby making such needle and pin cap assembly economically available to the buying public.

Still yet another object of the present invention is to provide a new needle and pin cap assembly which provides in the apparatuses and methods of the prior art some of the advantages thereof, while simultaneously overcoming some of the disadvantages normally associated therewith.

Still another object off the present invention is to provide a new needle and pin cap assembly for eliminating a user from being cut or stuck with the needle or pin.

Yet another object of the present invention is to provide a new needle and pin cap assembly which includes a first cap member assembly including a first cap member having a side wall, an open end, a closed end, and a cavity disposed therein; and also includes a second cap member having a side wall, a first end, and a second end which is adapted to receive a head portion of a needle or pin here through; and further includes an elastic elongate member being connected to the first cap member and to the second cap member and being adapted to hold the first end cap member and the second end cap member upon ends of the needle or pin.

Still yet another object of the present invention is to provide a new needle and pin cap assembly that is easy and convenient to use and place upon the ends of the needle or pin.

Even still another object of the present invention is to provide a new needle and pin cap assembly that improves safe handling of needles and pins.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
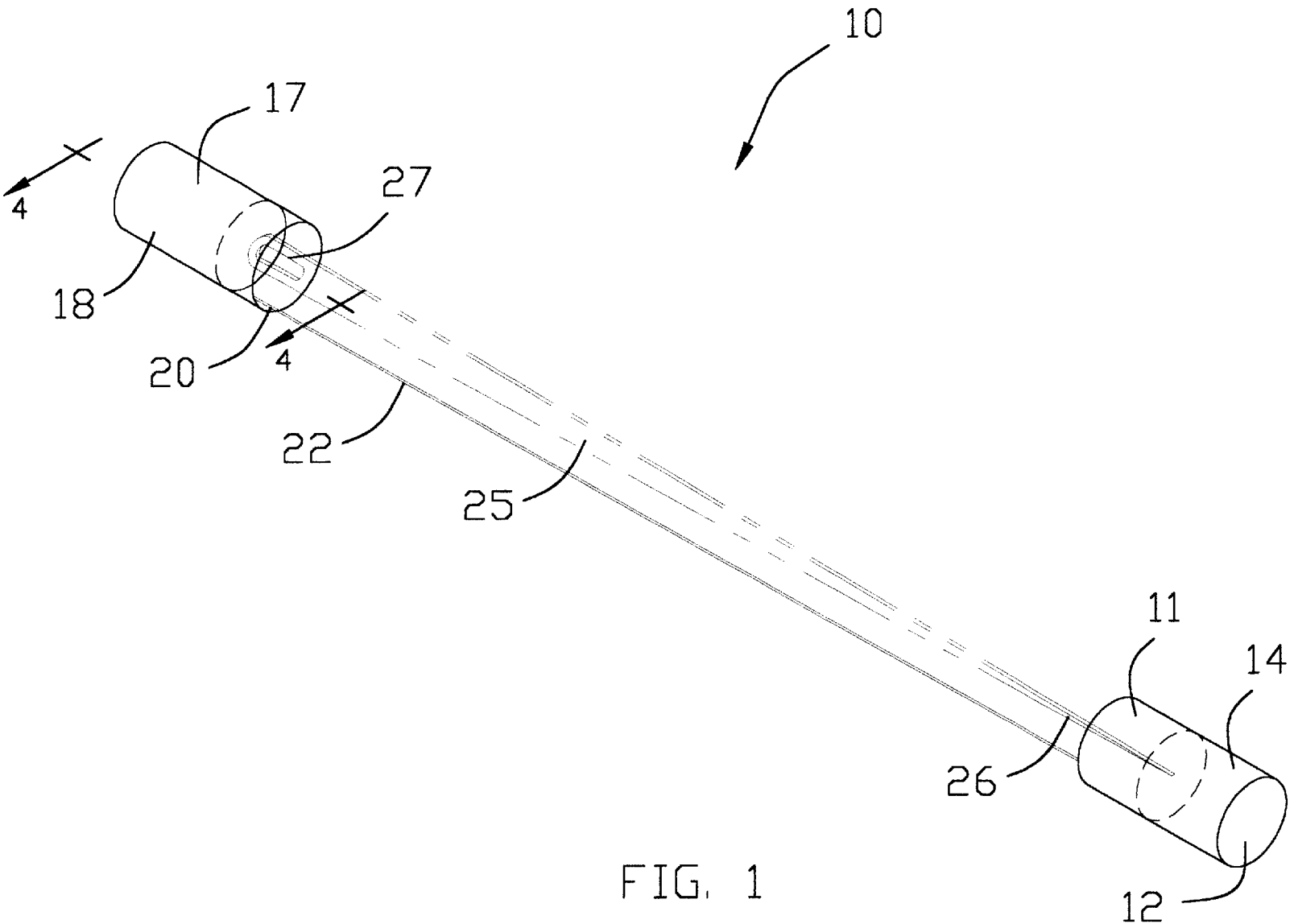
FIG. 1 is a perspective view of a new needle and pin cap assembly according to the present invention.
Figure 2:
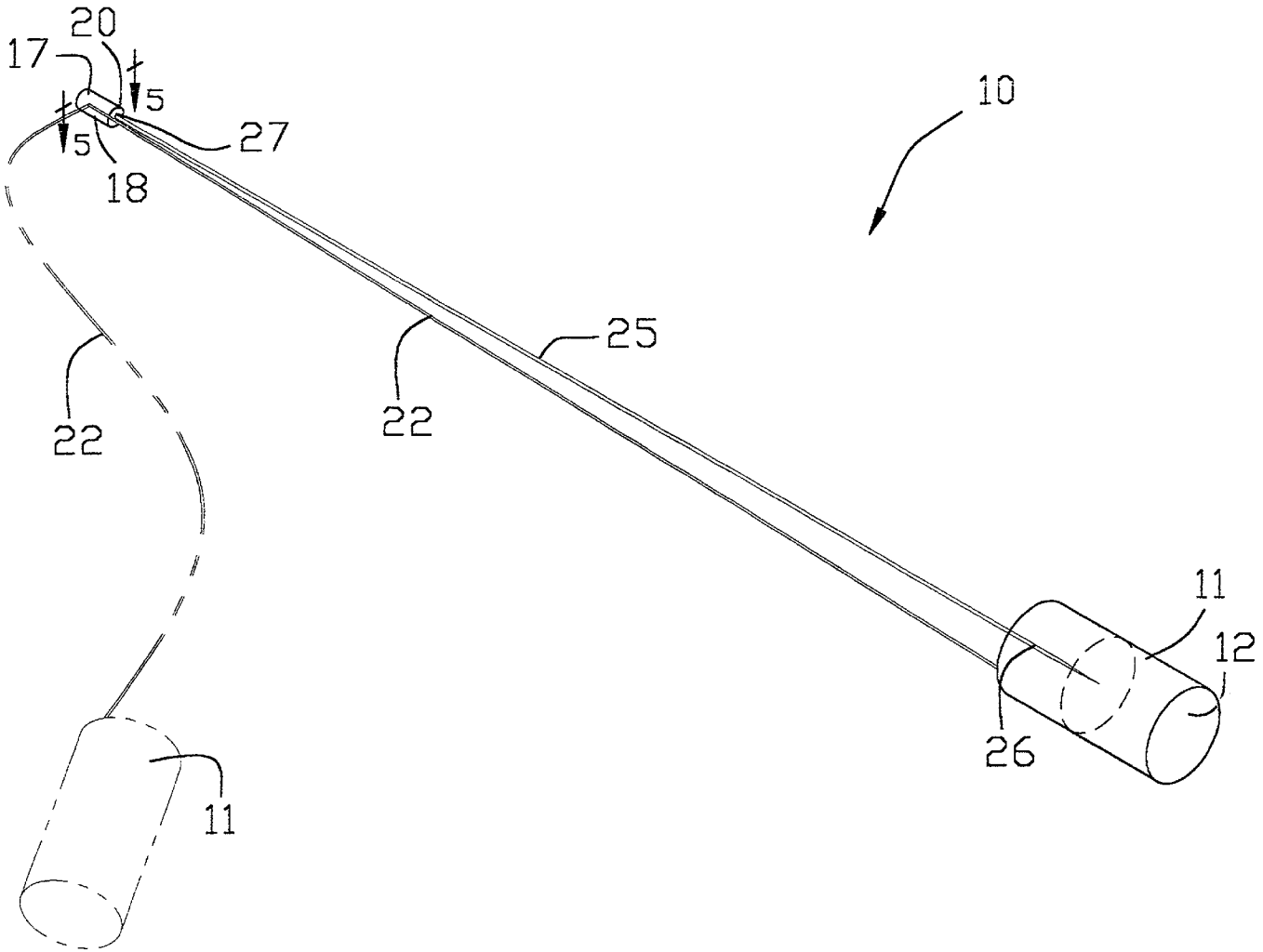
FIG. 2 is another perspective view of the present invention.
Figure 3:
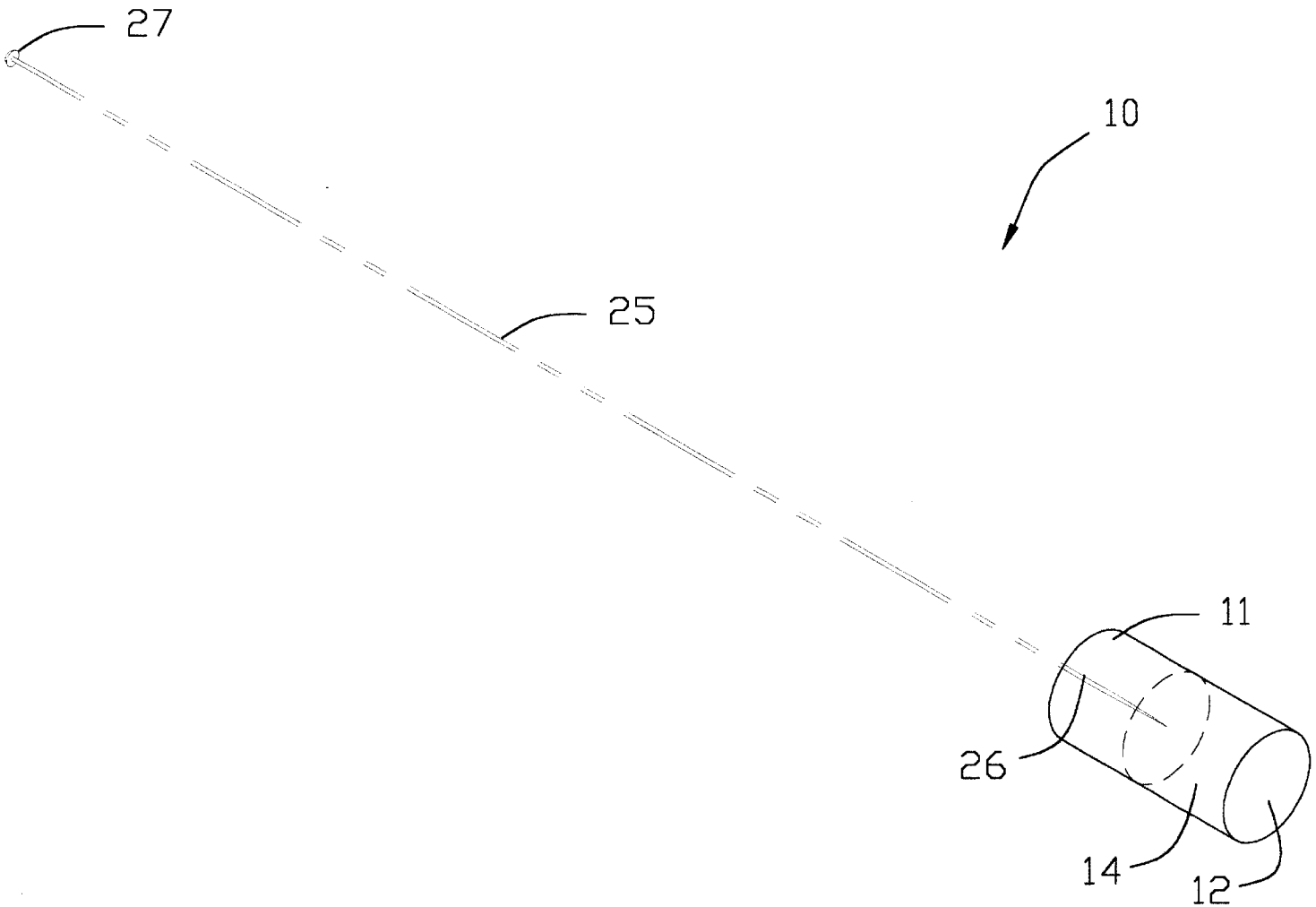
FIG. 3 is a detailed perspective view of the first cap member of the present invention.
Figure 5:
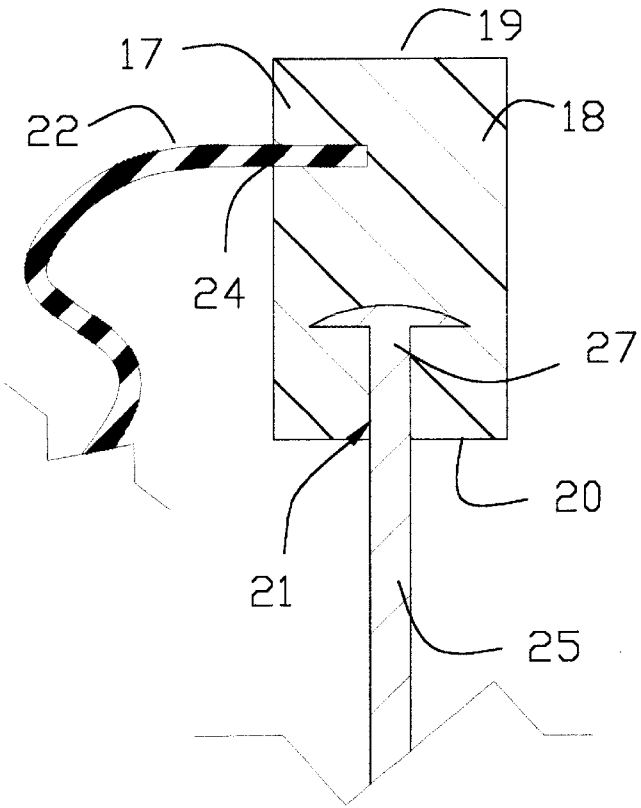
FIG. 5 is a cross sectional view of the second cap member of the present invention.
Figure 4:
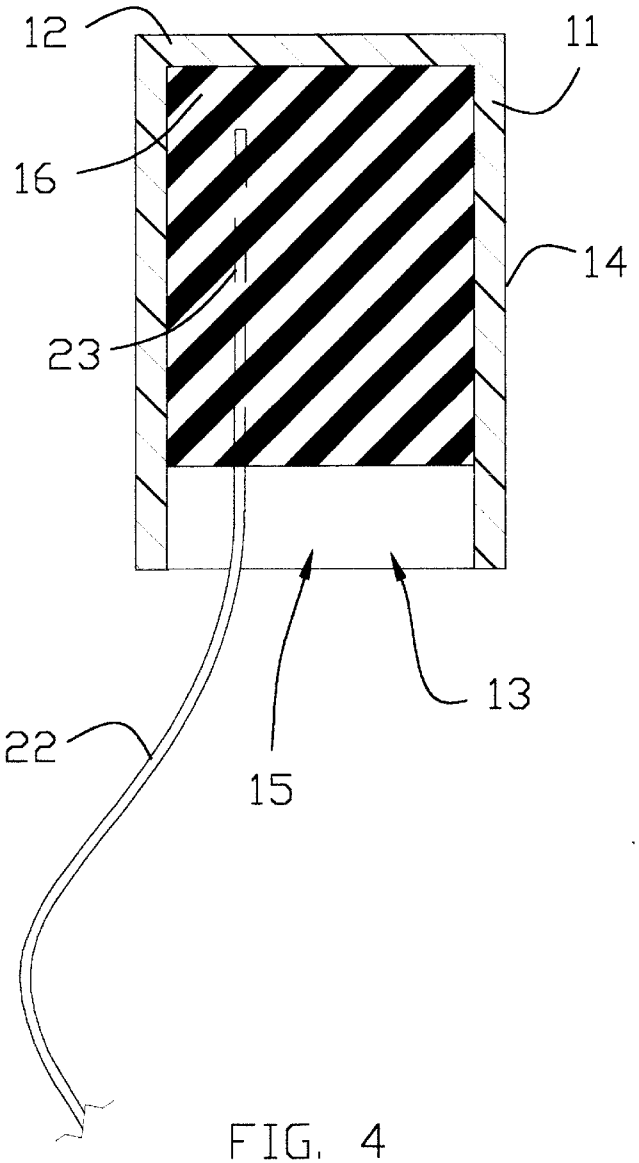
FIG. 4 is a cross-sectional view of the first cap member of the present invention.

With reference now to the drawings, and in particular to FIGS. 1 through 5 thereof, a new needle and pin cap assembly embodying the principles and concepts of the present invention and generally designated by the reference numeral 10 will be described.

As best illustrated in FIGS. 1 through 5, the needle and pin cap assembly 10 generally comprises a first cap member assembly including a first cap member 11 having a side wall 14, an open end 13, a closed end 12, and a cavity 15 disposed therein. The first cap member 11 is adapted to receive a pointed end portion 26 of the needle or pin 25 and is cylindrically shaped. The first cap member assembly also includes a cushion member 16 being securely disposed and wedged in the cavity 15 of the first cap member 11 and being adapted to receive the pointed end portion 26 therein. The cushion member 16 is generally made of rubber and is recessed in the first cap member 11.

A second cap member 17 having a side wall 18, a first end 19, and a second end 20 which is adapted to receive a head portion 27 of a needle or pin 25 there through. The second cap member 17 also has a bore 21 extending therein through the second end 20 thereof and being adapted to securely receive a head portion 27 of the needle or pin 25. The second cap member 17 is a solid cylindrical member. Each of the first and second cap members 11,17 has a length of approximately ¼ to ⅜ inches.

An elastic elongate member 22 is securely and conventionally connected to the first cap member 11 and to the second cap member 17 and is adapted to hold the first end cap member 11 and the second end cap member 17 upon ends of the needle or pin 25. The elastic elongate member 22 has a first end portion 23 which is securely and conventionally attached to the first cap member 11, and also has a second end portion 24 which is securely and conventionally disposed through the side wall 18 of the second cap member 17. The first end portion 23 of the elastic elongate member 22 is disposed in the cushion member 16 through the open end 13 of the first cap member 11 with the elastic elongate member 22 having a length of approximately 1 to 2 inches.

In use, the user places the first and second cap members 11,17 over the ends of the needle or pin 25 to protect the user from sticking oneself with the pointed end portion 26 of the needle or pin 25. To use the needle or pin 25, the user simply removes the first cap member 11 from the pointed end portion 27 of the needle or pin 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A needle and pin cap assembly comprising:

a first cap member assembly including a first cap member having a side wall, an open end, a closed end, and a cavity disposed therein, said first cap member being adapted to receive a pointed end portion of the needle or pin and is cylindrically shaped, said first cap member assembly also including a cushion member securely disposed in said cavity of said first cap member and being adapted to receive said pointed end portion therein, said cushion member being generally made of rubber and being recessed in said first cap member;

a second cap member having a side wall, a first end, and a second end which is adapted to receive a head portion of a needle or pin there through, said second cap member having a bore extending therein through said second end thereof and being adapted to receive a head portion of the needle or pin, said second cap member being a solid cylindrical member; each of said first and second cap members having a length of approximately ¼ to ⅜ inches; and an elastic elongate member being connected to said first cap member and to said second cap member and being adapted to hold said first end cap member and said second end cap member upon ends of the needle or pin, said elastic elongate member having a first end portion which is securely attached to said first cap member, and also having a second end portion which is securely attached to said second cap member, said first end portion of said elastic elongate member being disposed in said cushion member through said open end of said first cap member, said second end portion of said elastic elongate member being disposed in said cushion member through said open end of said second cap member, said elastic elongate member having a length of approximately 1 to 2 inches.

* * * * *